US005454728A

United States Patent [19]

Jack

[11] Patent Number: 5,454,728

[45] Date of Patent: Oct. 3, 1995

[54] LOCKING CONNECTOR FOR AN EXTENSION POWER CORD

[76] Inventor: Shane R. Jack, 316 E. Mill Plain Blvd., Vancouver, Wash. 98660

[21] Appl. No.: 238,490

[22] Filed: May 5, 1994

[51] Int. Cl.[6] ..... H01R 16/622

[52] U.S. Cl. ..... 439/277; 439/320

[58] Field of Search ..... 439/320, 321, 439/322, 323, 271, 275, 276, 277

[56] References Cited

U.S. PATENT DOCUMENTS

| | | | |
|---|---|---|---|
| 2,306,821 | 12/1942 | Markey | 439/320 |
| 2,739,290 | 3/1956 | Child et al. | 439/320 |
| 3,445,805 | 5/1969 | McLoad | 439/321 |
| 4,540,230 | 9/1985 | Iverson et al. | 439/320 |

FOREIGN PATENT DOCUMENTS

| | | | |
|---|---|---|---|
| 709777 | 8/1941 | Germany | 439/320 |
| 679049 | 9/1952 | United Kingdom | 439/277 |

*Primary Examiner*—Daniel W. Howell

[57] ABSTRACT

Disclosed is a locking connector for an extension power cord for providing a liquid resistant positive locking plug and receptacle combination whereby preventing unwanted separation of a plurality of connected together extension power cords. The locking connector is suitable for home and commercial use, indoors and outdoors. The locking connector for an extension power cord comprises a male electrical power plug assembly having a cylindrical body with external threads formed thereon and a female electrical power receptacle assembly having a captivated internally threaded locking sleeve engagable with the plug threads. The plug and receptacle are operably connected to opposing ends of an elongated multiconductor power cord. When locked together, planar front facing surfaces are sealed with an o-ring to resist liquid entry. Male electrical connector prongs project from the plug body and female sockets extend into the receptacle body in a conventional arrangement for providing electrical and mechanical interoperation with existing conventionally configured power plugs and receptacles.

1 Claim, 4 Drawing Sheets

LOCKING CONNECTOR FOR AN EXTENSION POWER CORD

BACKGROUND OF THE INVENTION

1. Field of the Invention

The present invention relates to electrical connecting devices and more particularly pertains to a locking connector for an extension power cord which may be adapted for providing a liquid resistant positive locking plug and receptacle combination whereby preventing unwanted separation of a plurality of connected together extension power cords, the locking connector being suitable for home and commercial use indoors and outdoors.

2. Description of the Prior Art

The use of electrical connecting devices is known in the prior art. More specifically, electrical connecting devices heretofore devised and utilized for the purpose of interconnecting temporary extension power cords are known to consist basically of familiar, expected and obvious structural configurations, notwithstanding the myriad of designs encompassed by the crowded prior art which have been developed for the fulfillment of countless objectives and requirements.

The present invention is directed to improving devices for interconnecting temporary extension power cords in a manner which is safe, secure, economical and aesthetically pleasing.

U.S. Pat. No. 5,114,352 to Gahagen et al. describes a rotatable marine electric connector for supplying shore power to a docked marine vessel. This device, while being suitable for its specific intended marine application, is bulky and overly complex for use with household and commercial extension power cords.

The prior art also discloses a safety twist lock connector for an extension power cord as shown in U.S. Pat. No. 4,907,985 to Johnsen and a snap lock extension cord and power tool connector of U.S. Pat. No. 5,069,634 to Chiarolanzio. Both the Johnsen and Chiarolanzio devices incorporate a locking feature, but neither of the disclosures show a way to seal the connectors to resist entry of liquid. Furthermore, the extending flexible finger of the Chiarolanzio invention is subject to breakage if the device is handled roughly, thereby rendering the locking means inoperative.

Other related patents include U.S. Pat. No. 4,836,807 to Singer which discloses a screw-plug-terminal and U.S. Pat. No. 5,169,334 to Makita which describes a screw-fastened electrical connector. While these devices fulfill their respective, particular objectives and requirements, these two patents do not disclose a locking connector for an extension power cord for providing a liquid resistant positive locking plug and receptacle combination.

In this respect, the locking connector for an extension power cord according to the present invention substantially departs from the conventional concepts and designs of the prior art, and in so doing provides an apparatus primarily developed for the purpose of providing a liquid resistant positive locking plug and receptacle combination whereby preventing unwanted separation of a plurality of connected together extension power cords, the locking connector being suitable for home and commercial use indoors and outdoors.

Therefore, it can be appreciated that there exists a continuing need for a new locking connector for an extension power cord which can be used for providing a liquid resistant positive locking plug and receptacle combination whereby preventing unwanted separation of a plurality of connected together extension power cords, the locking connector being suitable for home and commercial use indoors and outdoors. In this regard, the present invention substantially fulfills this need.

As illustrated by the background art, efforts are continuously being made in an attempt to develop devices for interconnecting temporary extension power cords. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of electrical connecting devices now present in the prior art, the present invention provides a new electrical connecting device construction wherein the same can be utilized for providing a liquid resistant positive locking plug and receptacle combination. As such, the general purpose of the present invention, which will be described subsequently in greater detail, is to provide a new locking connector for an extension power cord apparatus and method which has all the advantages of the prior art electrical connecting devices and none of the disadvantages.

The invention is defined by the appended claims with the specific embodiment shown in the attached drawings. For the purpose of summarizing the invention, the invention may be incorporated into a locking connector for an extension power cord for providing a liquid resistant positive locking plug and receptacle combination whereby preventing unwanted separation of a plurality of connected together extension power cords. The locking connector is suitable for home and commercial use, indoors and outdoors. The locking connector for an extension power cord comprises a male electrical power plug assembly and a female electrical power receptacle assembly operably connected to opposing ends of an elongated multiconductor power cord.

The male plug assembly comprises a generally cylindrical hollow plug body formed of dielectric material. The plug body has a planar front face with an o-ring sealing surface formed thereon. A plurality of external threads formed on the sidewall of the plug body adjacent the front face. An electrical cord entry aperture is formed in a rear end of the plug body. A plurality of male electrical connector prongs projects from the front face of the plug body. The connector prongs are configured in a conventional arrangement whereby providing electrical and mechanical interoperation with existing conventionally configured power receptacles. The connector prongs each have terminal means extending inside the hollow plug body whereto electrical power conducting wires may be attached.

The female receptacle assembly comprises a generally cylindrical hollow receptacle body formed of dielectric material. The receptacle body has a planar front face with a concentric circular o-ring seal retaining groove formed thereon with an o-ring seal retained therein. A circumferential external retaining flange extends around the receptacle body adjacent the front face thereof. An electrical cord entry aperture is formed in a rear end of the receptacle body. A pair of opposing external retaining tabs is formed on the sidewall of the receptacle body intermediate the ends. A plurality of female electrical connector sockets extends into the front face of the receptacle body, the connector sockets being configured in a conventional arrangement whereby providing electrical and mechanical interoperation with existing conventionally configured power plugs. The connector sockets each have terminal means extending inside the hollow receptacle body whereto electrical power conducting wires may be attached.

A tubular locking sleeve is slidably revolvably disposed around the receptacle body. The locking sleeve has an internal raised lip extending therearound adjacent a rear end thereof. The raised lip is captivated between the flange and the external retaining tabs of the receptacle body whereby preventing the sleeve from separating from the receptacle body while simultaneously allowing the sleeve limited longitudinal sliding motion with respect to the receptacle body. The sleeve further has a plurality of internal threads formed therein which are engagable with the external threads of the plug body such that when engaged the planar front face of the plug body is in spaced facing relationship with the planar front face of the receptacle body, the o-ring seal of the receptacle body is in touching sealing relationship with the sealing surface of the plug body, and the male electrical connector prongs are operably mated with the female electrical connector sockets whereby locking the plug to the receptacle while simultaneously resisting entry of liquid into the mated connector prongs and sockets.

The elongated flexible multiconductor electrical cord has an outer casing with insulated conducting wires therein configured in a conventional arrangement whereby providing electrical load carrying and mechanical characteristics suitable for an application. The first end of the cord extends through the electrical cord entry aperture of the plug body such that the outer casing forms an interference fit with the aperture whereby resisting entry of liquids into the plug body around the cord. The conducting wires of the first end are operably connected to the prong terminal means. The second end of the cord extends through the electrical cord entry aperture of the receptacle body such that the outer casing forms an interference fit with the aperture whereby resisting entry of liquids into the receptacle body around the cord. The conducting wires of the second end are operably connected to the socket terminal means.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a locking connector for an extension power cord for providing a positive locking plug and receptacle combination whereby preventing unwanted separation of a plurality of connected together extension power cords.

It is another object of the present invention to provide a new locking connector for an extension power cord which may be easily and efficiently manufactured and marketed.

It is a further object of the present invention to provide a new locking connector for an extension power cord which is of a durable and reliable construction.

An even further object of the present invention is to provide a new locking connector for an extension power cord which is susceptible of a low cost of manufacture with regard to both materials and labor, and which accordingly is then susceptible of low prices of sale to the consuming public, thereby making such locking connectors for an extension power cord economically available to the buying public.

Still yet another object of the present invention is to provide a new locking connector for an extension power cord which provides in the apparatuses and methods of the prior art some of the advantages thereof, while simultaneously overcoming some of the disadvantages normally associated therewith.

Still yet another object of the present invention is to provide a locking connector for an extension power cord that is suitable for home and commercial use indoors and outdoors.

Yet another object of the present invention is to provide a locking connector for an extension power cord that is compatible with existing conventional power plugs and receptacles.

Even still another object of the present invention is to provide a locking connector for an extension power cord that is dirt and liquid resistant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
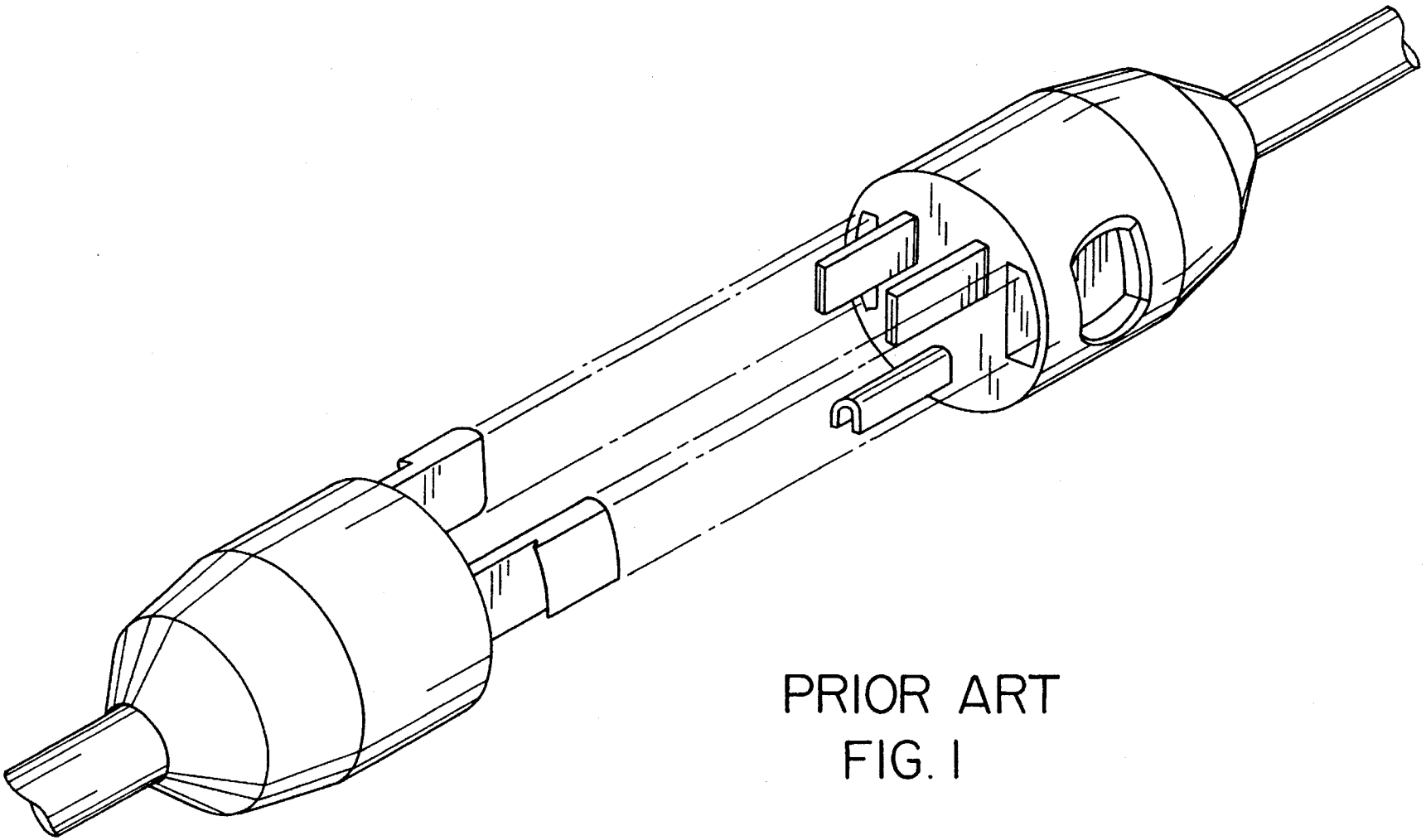
PRIOR ART FIG. 1
FIG. 1 is an illustration of a similar prior art device.
Figure 2:
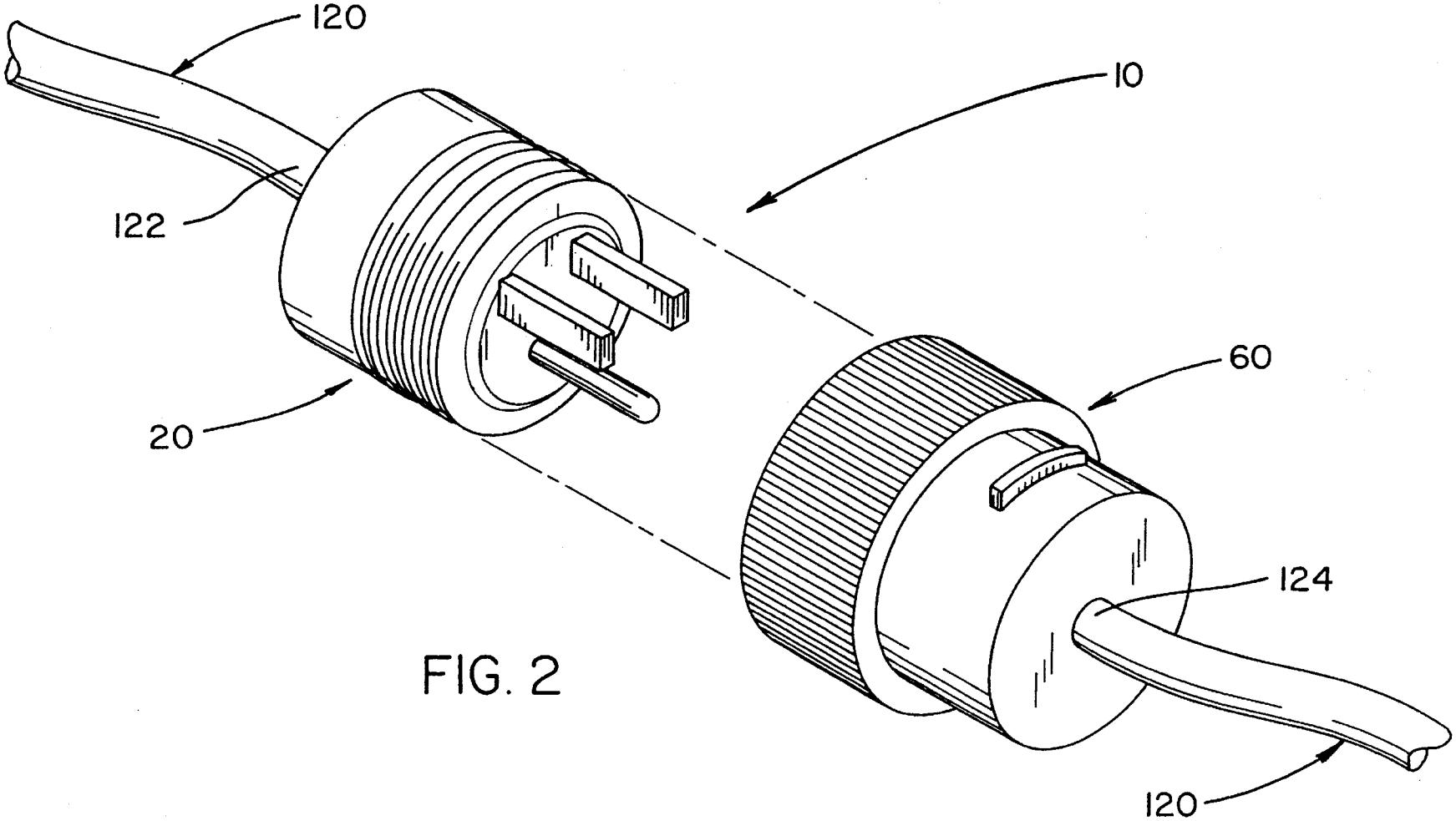
FIG. 2 is a top perspective view of the separated male plug and female receptacle of the present locking connector for an extension power cord.
Figure 3:
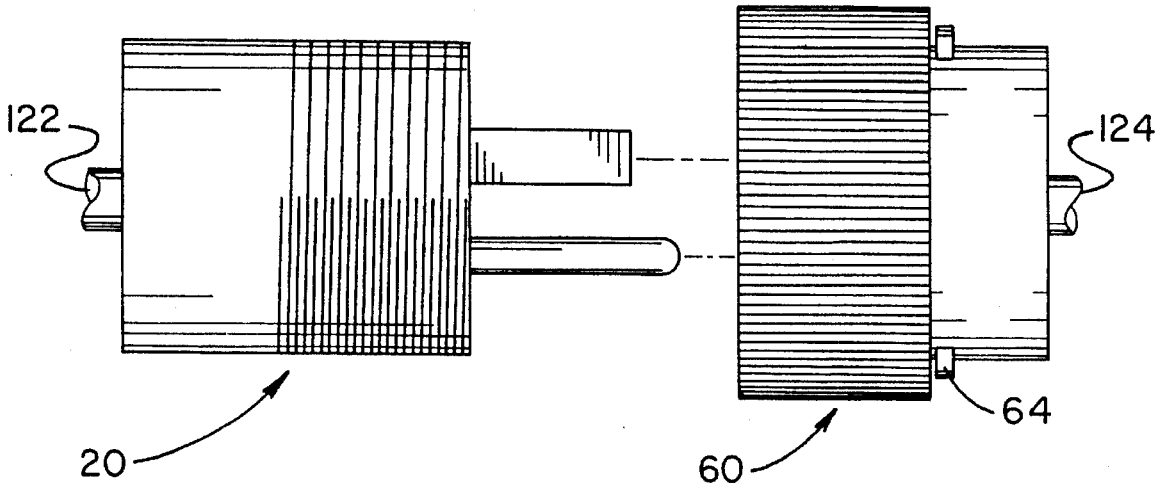
FIG. 3 is a side elevational view of the invention of FIG. 2.
Figure 4:
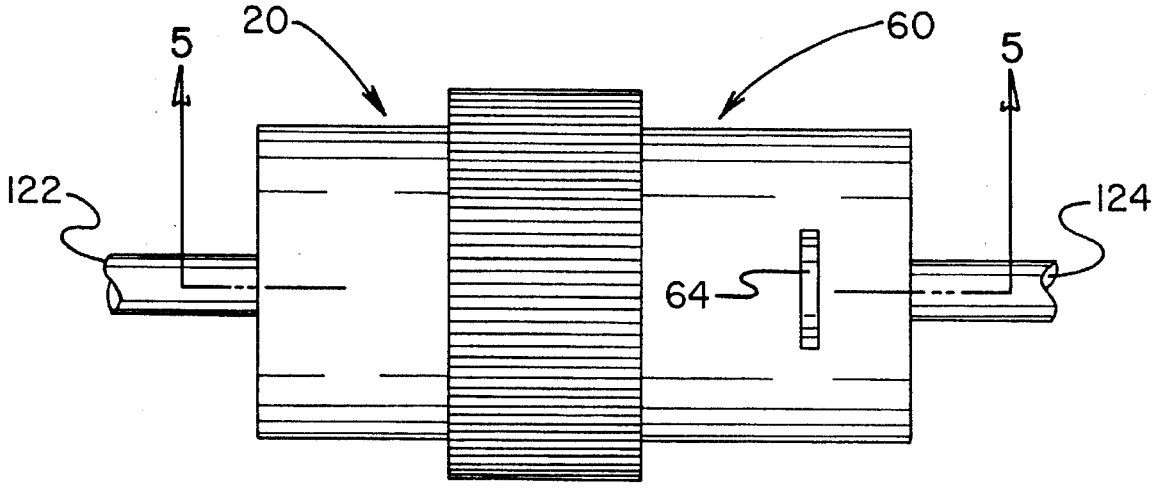
FIG. 4 is another side elevational view of the invention of FIG. 2 showing the plug and receptacle mated and locked together.
Figure 5:
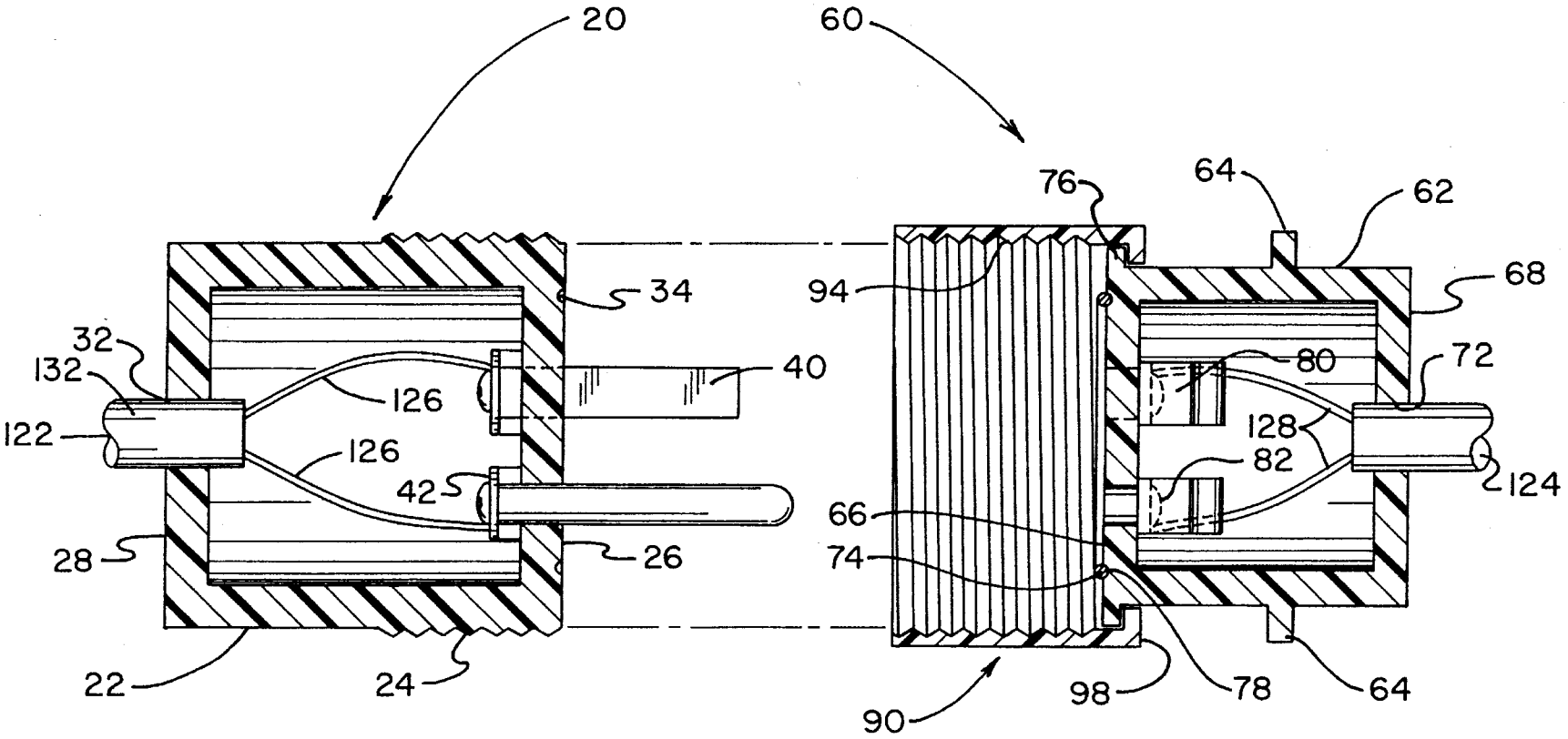
FIG. 5 is a sectional view of the invention of FIG. 4 taken along the line 5—5 and showing the plug and receptacle separated.

With reference now to the drawings, and in particular to FIG. 2 thereof, a locking connector for an extension power cord embodying the principles and concepts of the present invention and generally designated by the reference numeral 10 will be described.

From an overview standpoint, the locking connector for an extension power cord is adapted for use for providing a liquid resistant positive locking plug and receptacle combination whereby preventing unwanted separation of a plurality of connected together extension power cords, the locking connector being suitable for home and commercial use indoors and outdoors. See FIG. 2.

With reference now to FIGS. 2–5 and more specifically, it will be noted that a locking connector for an extension power cord 10 is shown. The locking connector for an extension power cord 10 comprises a male electrical power plug assembly 20 and a female electrical power receptacle assembly 60 operably connected to opposing ends 122 and 124 of an elongated multiconductor power cord 120.

The male plug assembly 20 comprises a generally cylindrical hollow plug body 22 formed of dielectric material. The plug body 22 has a planar front face 26 with an o-ring sealing surface 34 formed thereon. A plurality of external threads 24 is formed on the sidewall of the plug body 22 adjacent the front face 26. An electrical cord entry aperture 32 is formed in a rear end 28 of the plug body 22. A plurality of male electrical connector prongs 40 projects from the front face 26 of the plug body 22. The connector prongs 40 are configured in a conventional arrangement whereby providing electrical and mechanical interoperation with existing conventionally configured power receptacles. The connector prongs 40 each have screw terminals 42 extending inside the hollow plug body whereto electrical power conducting wires 126 may be attached.

The female receptacle assembly 60 comprises a generally cylindrical hollow receptacle body 62 formed of dielectric material. The receptacle body 62 has a planar front face 66 with a concentric circular o-ring seal retaining groove 78 formed thereon with an o-ring seal 74 retained therein. A circumferential external retaining flange 76 extends around the receptacle body 62 adjacent the front face 66 thereof. An electrical cord entry aperture 72 is formed in a rear end 68 of the receptacle body 62. A pair of opposing external retaining tabs 64 is formed on the sidewall of the receptacle body 62 intermediate the ends 66 and 68. A plurality of female electrical connector sockets 80 extends into the front face 66 of the receptacle body 62, the connector sockets 80 being configured in a conventional arrangement whereby providing electrical and mechanical interoperation with existing conventionally configured power plugs. The connector sockets 80 each have screw terminals 82 extending inside the hollow receptacle body 62 whereto electrical power conducting wires 128 may be attached.

A tubular locking sleeve 90 is slidably revolvably disposed around the receptacle body 62. The locking sleeve 90 has an internal raised lip 98 extending therearound adjacent a rear end thereof. The raised lip 98 is captivated between the flange 76 and the external retaining tabs 64 of the receptacle body 62 whereby preventing the sleeve 90 from separating from the receptacle body 62 while simultaneously allowing the sleeve 90 limited longitudinal sliding motion with respect to the receptacle body 62. The sleeve 90 further has a plurality of internal threads 94 formed therein which are engagable with the external threads 24 of the plug body 62 such that when engaged the planar front face 26 of the plug body 62 is in spaced facing relationship with the planar front face 66 of the receptacle body 62, the o-ring seal 74 of the receptacle body 62 is in touching sealing relationship with the sealing surface 34 of the plug body 62, and the male electrical connector prongs 40 are operably mated with the female electrical connector sockets 80 whereby locking the plug 20 to the receptacle 60 while simultaneously resisting entry of liquid into the mated connector prongs and sockets 40 and 80.

The elongated flexible multiconductor electrical cord 120 has an outer casing 132 with insulated conducting wires 126 and 128 therein configured in a conventional arrangement whereby providing electrical load carrying and mechanical characteristics suitable for an application. The first end 122 of the cord 120 extends through the electrical cord entry aperture 32 of the plug body 62 such that the outer casing 132 forms an interference fit with the aperture 32 whereby resisting entry of liquids into the plug body 62 around the cord 120. The conducting wires 126 of the first end 122 are operably connected to the prong screw terminals 42. The second end 124 of the cord 120 extends through the electrical cord entry aperture 72 of the receptacle body 62 such that the outer casing 132 forms an interference fit with the aperture 72 whereby resisting entry of liquids into the receptacle body 62 around the cord 120. The conducting wires 128 of the second end 124 are operably connected to the socket screw terminals 82.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A locking connector for an extension power cord for providing a liquid resistant positive locking plug and receptacle combination whereby preventing unwanted separation of a plurality of connected together extension power cords, the locking connector being suitable for home and commercial use indoors and outdoors, the locking connector for an extension power cord comprising:

a male electrical power plug assembly comprising: a generally cylindrical hollow plug body formed of dielectric material, the plug body having a planar front face with an o-ring sealing surface formed thereon, a plurality of external threads formed on the sidewall thereof adjacent the front face, and an electrical cord entry aperture formed in a rear end thereof; a plurality of male electrical connector prongs projecting from the front face of the plug body, the connector prongs being configured in a conventional arrangement whereby providing electrical and mechanical interoperation with existing conventionally configured power receptacles, the connector prongs each having screw terminals extending inside the hollow plug body whereto electrical power conducting wires may be attached;

a female electrical power receptacle assembly comprising: a generally cylindrical hollow receptacle body formed of dielectric material, the receptacle body having a planar front face with a concentric circular o-ring seal retaining groove formed thereon, a circumferential external retaining flange extending therearound adjacent the front face thereof, an electrical cord entry aperture formed in a rear end thereof, and a pair of opposing external retaining tabs formed on the sidewall thereof intermediate the ends and extended annularly therearound; an o-ring seal retained within the circular groove of the receptacle body front face; a plurality of female electrical connector sockets extending into the front face of the receptacle body, the connector sockets being configured in a conventional arrangement whereby providing electrical and mechanical interoperation with existing conventionally configured power plugs, the connector sockets each having screw terminals extending inside the hollow receptacle body whereto electrical power conducting wires may be attached;

a tubular locking sleeve slidably revolvably disposed around the receptacle body, the locking sleeve having an internal raised lip extending therearound adjacent a rear end thereof, the raised lip being captivated between the flange and the external retaining tabs of the receptacle body whereby preventing the sleeve from separating from the receptacle body while simultaneously allowing the sleeve limited longitudinal sliding motion with respect to the receptacle body, the sleeve further having a plurality of internal threads formed therein engagable with the external threads of the plug body such that when engaged the planar front face of the plug body is in spaced facing relationship with the planar front face of the receptacle body and the o-ring seal of the receptacle body is in touching sealing relationship with the sealing surface of the plug body and the male electrical connector prongs are operably mated with the female electrical connector sockets whereby locking the plug to the receptacle while simultaneously resisting entry of liquid into the mated connector prongs and sockets; and an elongated flexible multiconductor electrical cord having an outer casing with insulated conducting wires therein configured in a conventional arrangement whereby providing electrical load carrying and mechanical characteristics suitable for an application, a first end of the cord extending through the electrical cord entry aperture of the plug body such that the outer casing forms an interference fit with the aperture whereby resisting entry of liquids into the plug body around the cord, the conducting wires of the first end being operably connected to the prong screw terminals, a second end of the cord extending through the electrical cord entry aperture of the receptacle body such that the outer casing forms an interference fit with the aperture whereby resisting entry of liquids into the receptacle body around the cord, the conducting wires of the second end being operably connected to the socket screw terminals.

* * * * *